US011136157B2

(12) United States Patent
Wu

(10) Patent No.: US 11,136,157 B2
(45) Date of Patent: Oct. 5, 2021

(54) SLEEVE LABELING MACHINE AND SLEEVE LABELING DEVICE THEREOF

(71) Applicant: HARDGOODS COMPANY, Taoyuan (TW)

(72) Inventor: Chin-Tsai Wu, Taoyuan (TW)

(73) Assignee: Hardgoods Company, Taoyuan (TW)

( * ) Notice: Subject to any disclaimer, the term of this patent is extended or adjusted under 35 U.S.C. 154(b) by 154 days.

(21) Appl. No.: 16/596,993

(22) Filed: Oct. 9, 2019

(65) Prior Publication Data

US 2020/0130882 A1 Apr. 30, 2020

(30) Foreign Application Priority Data

Oct. 24, 2018 (TW) ..... 107137643
Oct. 24, 2018 (TW) ..... 107137644

(51) Int. Cl.
*B65C 9/18* (2006.01)
*B65C 9/38* (2006.01)

(52) U.S. Cl.
CPC ..... *B65C 9/1803* (2013.01); *B65C 9/38* (2013.01); *B65C 2009/1834* (2013.01)

(58) Field of Classification Search
CPC . B65C 9/1803; B65C 9/38; B65C 2009/1894; B65C 3/065
See application file for complete search history.

(56) References Cited

U.S. PATENT DOCUMENTS 10,611,508 B2 * 4/2020 Wang ..... B65C 9/04
2004/0221962 A1 * 11/2004 Haung ..... B65B 9/14 156/538
2017/0166339 A1 * 6/2017 Wang ..... B65B 9/13

* cited by examiner

*Primary Examiner* — Omar Flores Sanchez
(74) *Attorney, Agent, or Firm* — Rosenberg, Klein & Lee

(57) ABSTRACT

A sleeve labeling machine has a work platform, a feeding unit, a conveying unit, a sleeve labeling device and a hot drying device. The feeding unit holds objects to be sleeved with labels. The conveying unit conveys the objects provided by feeding unit. The sleeve labeling device has a first guiding wheel assembly, a second guiding wheel assembly and a rotary cutter assembly. The first guiding wheel assembly and the second guiding wheel assembly guide the label to a predetermined position, the rotary cutter assembly cuts the label at the predetermined position into a first segment label and a second segment label, and before the second segment label is sleeved to the objects, the second guiding wheel assembly guides the second segment label to move, so that the first and second segment labels have a segment gap therebetween. The hot drying device performs a hot drying shrinkage operation.

10 Claims, 13 Drawing Sheets

SLEEVE LABELING MACHINE AND SLEEVE LABELING DEVICE THEREOF

BACKGROUND

1. Technical Field

The present disclosure relates to a sleeve labeling machine, and in particular to, a sleeve labeling machine which reduces a manufacturing cost and has a simple structure

2. Related Art

There are several structures of sleeve labeling machines utilized by sleeve labeling machines. Generally, the conventional sleeve labeling manner is to emit labels to objects, specifically, after a sleeve label tape is installed on a label tray, guided and drawn by guiding wheels, and disposed through and opened by the central guide column, an upper and lower drive wheels of a conveying device and a pressing wheel of the central guide column press the sleeve label tape, and a supporting wheel being vertical to the drive wheels and the pressing wheel of the central guide column press the sleeve label tape. Next, the sleeve label tape is successfully transmitted downward by the conveying device, and a cutting device can cut the sleeve label tape being located with several segments of specific lengths. Then, when an object to be sleeved with the label is transmitted to a set position under the central guide column, an emit labeling wheel of an emit labeling device and the pressing wheel of the central guide column drive the cut sleeve label tape to move downward quickly, and thus the operation for sleeving the label to the object can be achieved. However, though the above manner can achieve the operation for sleeving the label to the object, it is not suitable to the object which has a small volume or is hard to stand since there is a high possibility that the object falls down or is unstable during the transmission, so that it causes the problem of hardly sleeving the label to the object.

To solve the above problems, an sleeve labeling mechanism structure is provided on the market, in which a main object to be sleeved with the label enters a material distribution tray via a feeding device, and the sleeve label tape enters a label distribution tray after a tape driving device and cutting device set a specific length of the sleeve label tape. The material distribution tray and the label distribution tray rotate synchronously and make the object to be sleeved with the label correspond to a label. A propulsion device disposed on an adjacent side of the label distribution tray rotates synchronously with the material distribution tray and the label distribution tray, and the propulsion device can push the label to be sleeved to the object smoothly and precisely. However, the material distribution tray and the label distribution tray must rotate synchronously, and difference between their rotating speeds cannot be allowed. When the material distribution tray and the label distribution tray do not rotate synchronously, most labels cannot be precisely sleeved, especially, when one label is not successfully sleeved, most of the next labels are not successfully sleeved. Thus, calibration and observation of labors are needed, and during the label sleeving and conveying procedures, the serious condition of the object and the label is required, so that it increases the difficulty of the flow control and management. Further, the allocation of the sleeve labeling mechanism structure has a higher complexity, a serious condition and more devices, which causes the higher manufacturing cost.

SUMMARY

An objective of the present disclosure is to provide a sleeve labeling machine which reduces a manufacturing cost and has a simple structure.

Another objective of the present disclosure is to provide a sleeve labeling machine which can precisely and stably sleeve the label to objects to be sleeved with the labels, so as to increase a yielding rate for sleeving the labels.

The technical features of the present disclosure are illustrated as follows.

The present disclosure provides a sleeve labeling machine comprising a work platform, a feeding unit, a conveying unit, a sleeve labeling device and a hot drying device. The feeding unit is allocated on the work platform and configured to carry objects to be sleeved with labels. The conveying unit allocated on the work platform and one side of the feeding unit, and the mold is disposed adjacent to the conveying unit for conveying the objects provided by the feeding unit. The sleeve labeling device is allocated on the work platform, and sleeve labeling device comprises a base, a central guide column, a first guiding wheel assembly, a second guiding wheel assembly and a rotary cutter assembly. The central guide column is allocated on the base and the label can be sleeved to the central guide column, the central guide column comprises a column body and a mold connected to the column body. The first guiding wheel assembly is allocated on one side of the base, and the first guiding wheel assembly comprises a first guiding wheel and a second guiding wheel, both of which are allocated along a first axial direction, and the column body is allocated between the first guiding wheel and the second guiding wheel. The second guiding wheel assembly is allocated on another side of the base, the second guiding wheel assembly comprises a third guiding wheel and a fourth guiding wheel, both of which are allocated along a second axial direction. The first axial direction is not parallel to the second axial direction, and the mold is allocated between the third guiding wheel and the fourth guiding wheel. The first guiding wheel assembly and the second guiding wheel assembly guide the label to a predetermined position, and the rotary cutter assembly cut the label into a first segment label and a second segment label at the predetermined position. Before the second segment label is sleeved to the object, the second guiding wheel assembly guides the second segment label to move, so that the first and second segment labels have a segment gap therebetween. The hot drying device is allocated on the work platform, and performs a hot drying shrinkage operation on the objects sleeved with the labels.

In an embodiment of the present disclosure, the second guiding wheel assembly guides the second segment label move to a first position near the object, and the second guiding wheel continuously guides the second segment label from the first position to a second position away from the object, so that the first and second segment labels have the segment gap therebetween.

In an embodiment of the present disclosure, the sleeve labeling machine further comprises a pre-shrinking device allocated on the work platform and between the sleeve labeling device and the hot drying device. Before the hot drying device hot drying shrinkage operation on the objects sleeved with the labels, the pre-shrinking device performs a pre-shrinkage operation on the objects sleeved with the labels.

In an embodiment of the present disclosure, the sleeve labeling device further comprises a third guiding wheel assembly allocated on the base, the second guiding wheel assembly is disposed between the third guiding wheel assembly and the first guiding wheel assembly. The third guiding wheel assembly, the first guiding wheel assembly and the second guiding wheel assembly guide the label to a predetermined position, and before the second segment label is sleeved to the object, the second guiding wheel assembly and the first guiding wheel assembly guide the second segment label to move, so that the first and second segment labels have the segment gap therebetween.

In an embodiment of the present disclosure, the first guiding wheel assembly comprises a first guiding wheel and a second guiding wheel, both of which are allocated along a first axial direction, and the column body is allocated between the first guiding wheel and the second guiding wheel. The second guiding wheel assembly comprises a third guiding wheel and a fourth guiding wheel, both of which are allocated along a second axial direction. Third guiding wheel assembly comprises a fifth guiding wheel and a sixth guiding wheel, both of which are allocated along the first axial direction. The first axial direction is not parallel to the second axial direction, the mold is allocated between the third guiding wheel and the fourth guiding wheel, and the mold is disposed between the third through sixth guiding wheels.

In an embodiment of the present disclosure, the sleeve labeling device further comprises a plate body allocated on the base. The plate body extends along first axial direction and away from the base, and the plate body comprises a first surface and a second surface being opposite to the first surface. The first surface faces to the first guiding wheel assembly, the second surface faces to the second guiding wheel assembly, and the central guide column penetrates from the first surface to the second surface and is disposed through the plate body.

In an embodiment of the present disclosure, the sleeve labeling device further comprises a rotary cutter assembly allocated on the plate body, the rotary cutter assembly comprises a rotating wheel and cutters allocated on the rotating wheel, and the cutters surround the central guide column.

In an embodiment of the present disclosure, the sleeve labeling device further comprises a driving assembly allocated on the plate body. The driving assembly comprises a motor, a drive wheel and a drive belt, wherein the drive belt is sleeved to the drive wheel and the rotating wheel of the rotary cutter assembly, the motor drives the drive wheel to rotate and drive the drive belt, so that the drive belt drives the rotating wheel to rotate, and the cutters of the rotary cutter assembly rotates in respect to the central guide column.

The present disclosure further provides a label guiding method used in a sleeve labeling machine, wherein the sleeve labeling machine comprises a sleeve labeling device, and the sleeve labeling device comprises a first guiding wheel assembly, a second guiding wheel assembly and a rotary cutter assembly. The label guiding method comprises steps as follows: providing a label and an object to be sleeved with the label; utilizing the first guiding wheel assembly and the second guiding wheel assembly to guide the label to a predetermined position; utilizing the rotary cutter assembly to cut the label into a first segment label and second segment label at the predetermined position; before the second segment label is sleeved to the object, utilizing the second guiding wheel assembly to guide the second segment label to move, so that the first and second segment labels have a segment gap therebetween.

In an embodiment of the present disclosure, the second guiding wheel assembly guides the second segment label to a first position near the object, and the second guiding wheel assembly continuously guides the second segment label from the first position to a second position away from the object, so that the first and second segment labels have the segment gap therebetween.

The technical results of the present disclosure are illustrated as follows. The sleeve labeling machine of the embodiment of the present disclosure utilizes its first guiding wheel assembly and second guiding wheel assembly to guide the label to a predetermined position, then utilizes its rotary cutter assembly to cut the label at the predetermined position into the first and second segment labels, and before the second segment label is sleeved to the object, the second guiding wheel assembly guides the second segment label to move, so that the first and second segment labels have the segment gap therebetween. When the label is not cut completely, by such guiding manner, it can make sure that the cut label can depart completely, such that the label can be precisely and quickly sleeved to the object, and the yielding rate of sleeving the labels is increased efficiently. Further, the sleeve labeling machine of the embodiment of the present disclosure has a simple structure design, and the label is merely guided by the first guiding wheel assembly and the second guiding wheel assembly to be successfully sleeved to the object without allocating an additional label distribution tray or other device. Therefore, under such structure design, the manufacturing cost can be dramatically reduced, and the yielding rate of sleeving the labels is greatly increased.

BRIEF DESCRIPTIONS OF DRAWINGS

DESCRIPTIONS OF EXEMPLARY EMBODIMENTS

Figure 1:
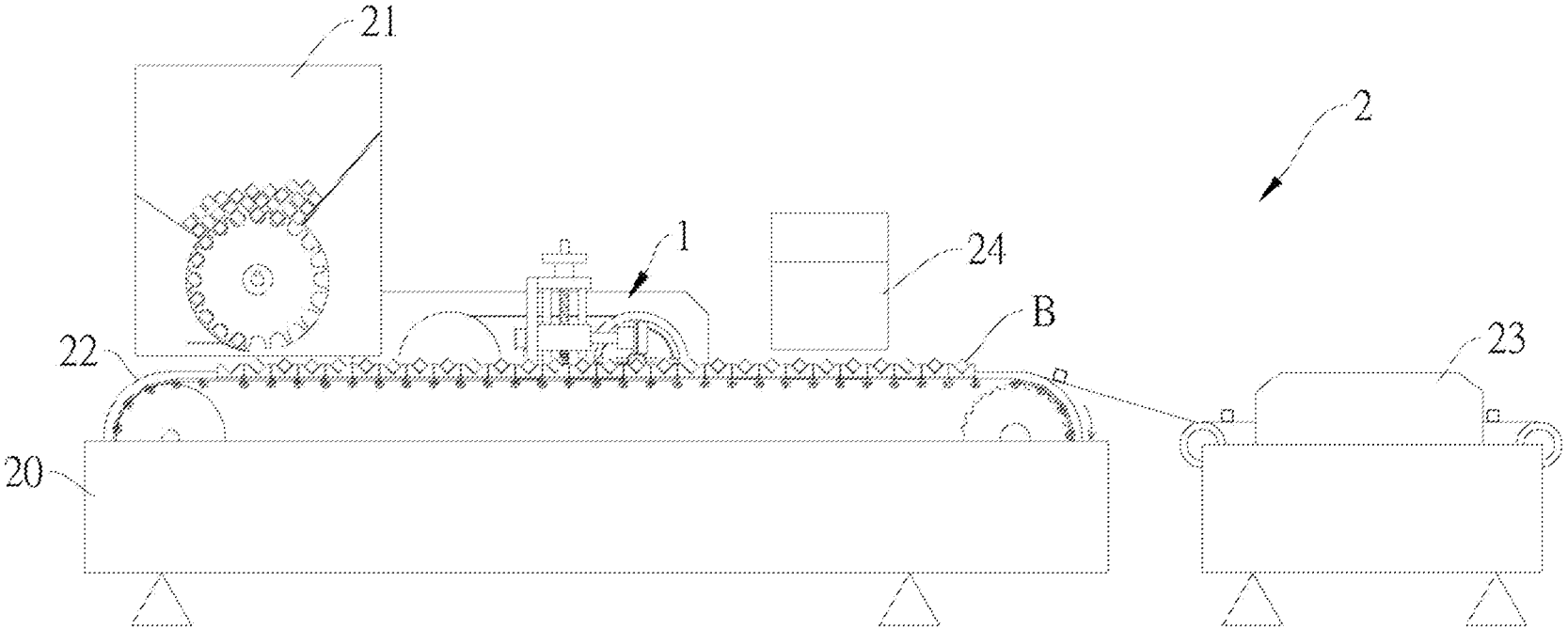
FIG. 1 is a structure diagram showing a sleeve labeling machine in the present disclosure.
Figure 2:
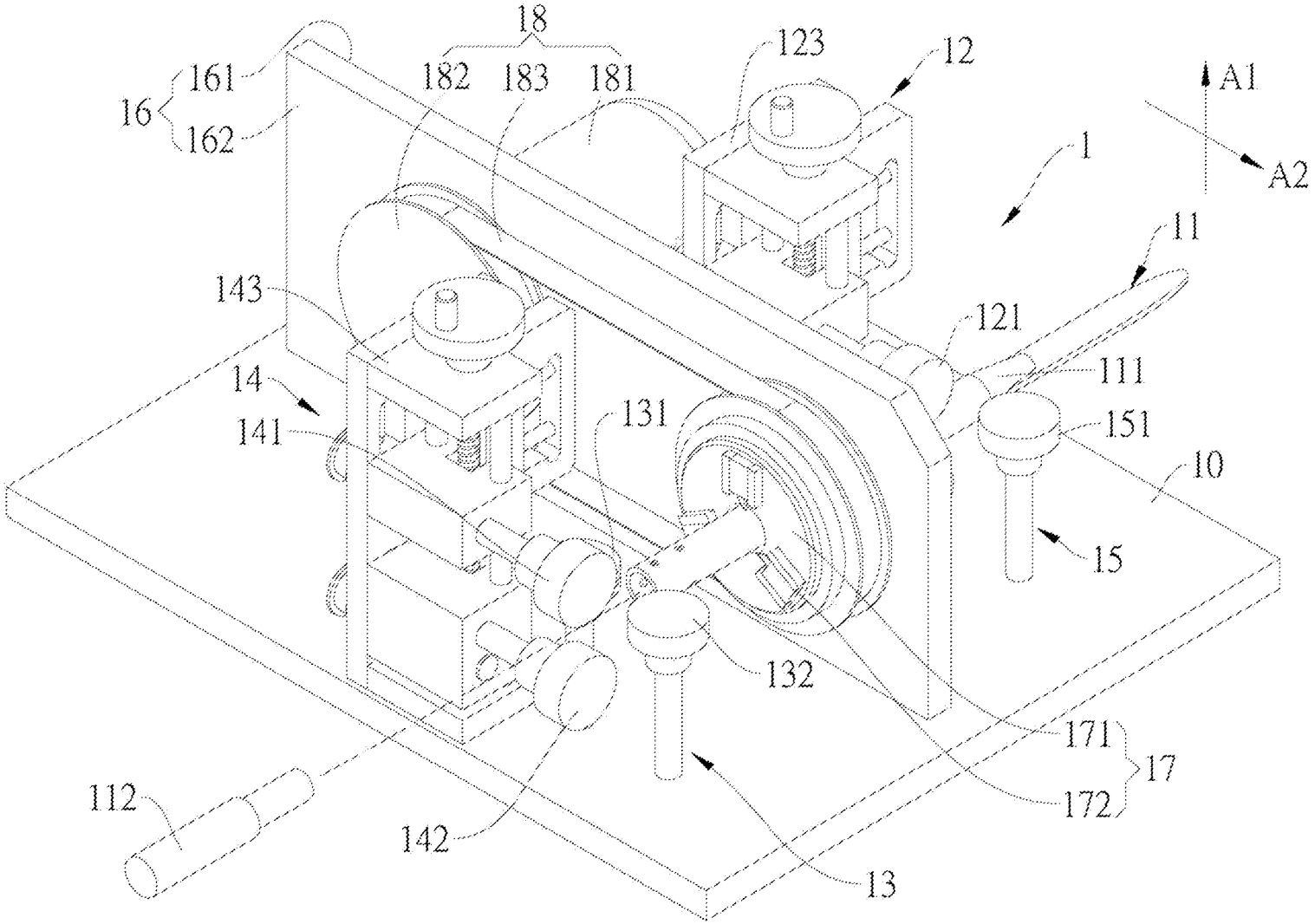
FIG. 2 is an explosive diagram showing a mold of a sleeve labeling device associated with a sleeve labeling machine in the present disclosure.
Figure 3:
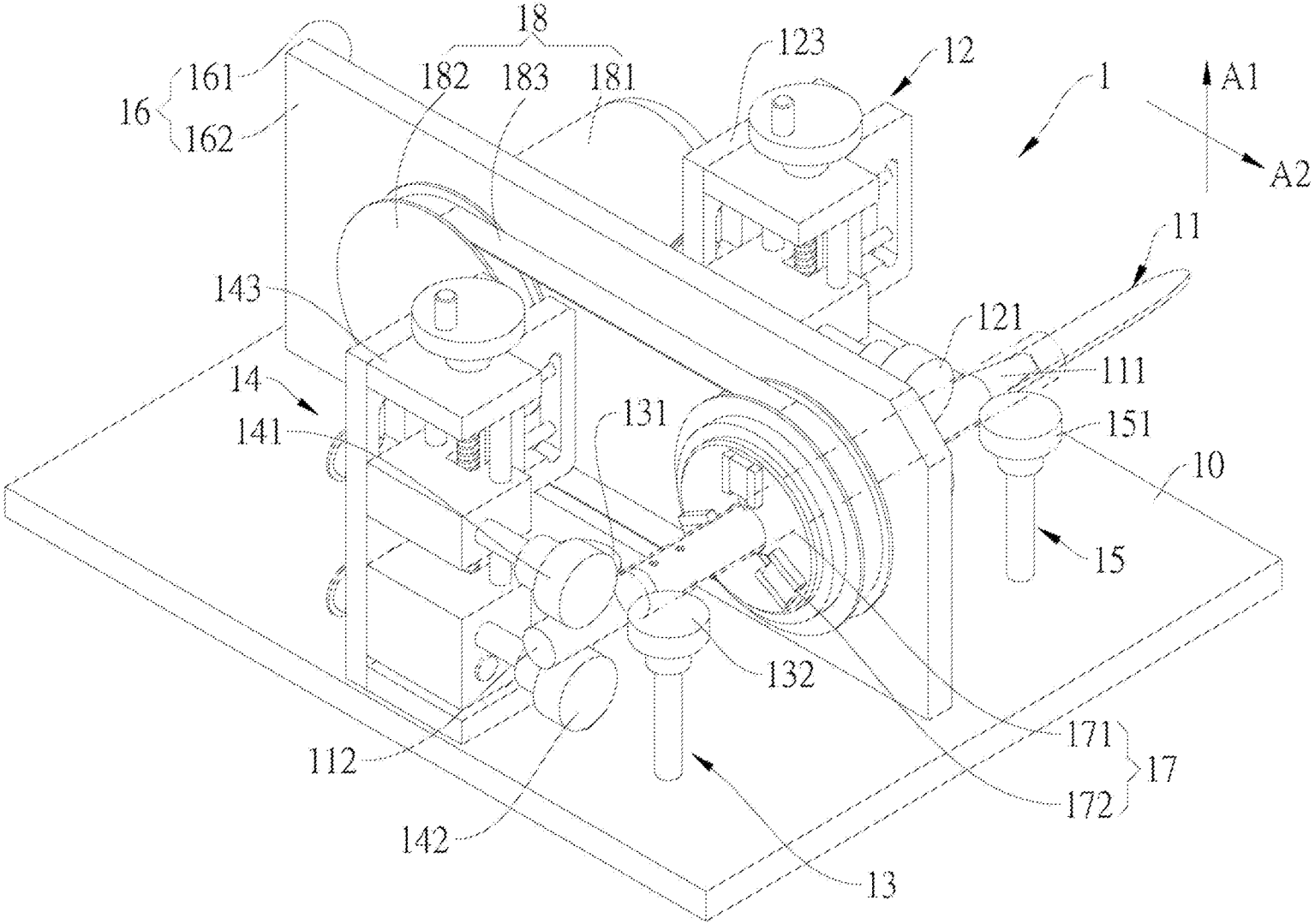
FIG. 3 is a three dimensional structure diagram showing a sleeve labeling device of a sleeve labeling machine in the present disclosure.
Figure 4:
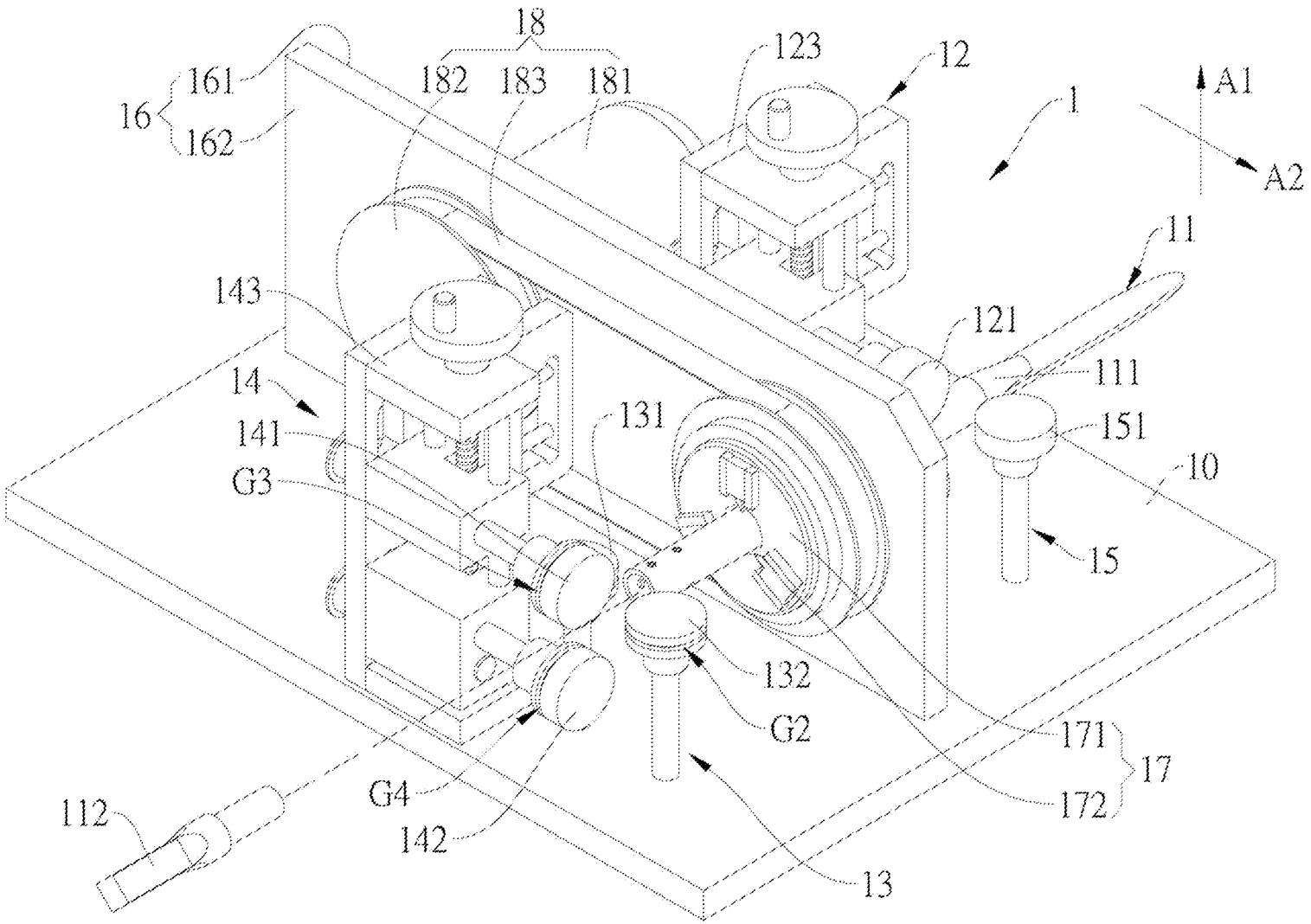
FIG. 4 is an explosive diagram showing another mold of a sleeve labeling device in the present disclosure.
Figure 5:
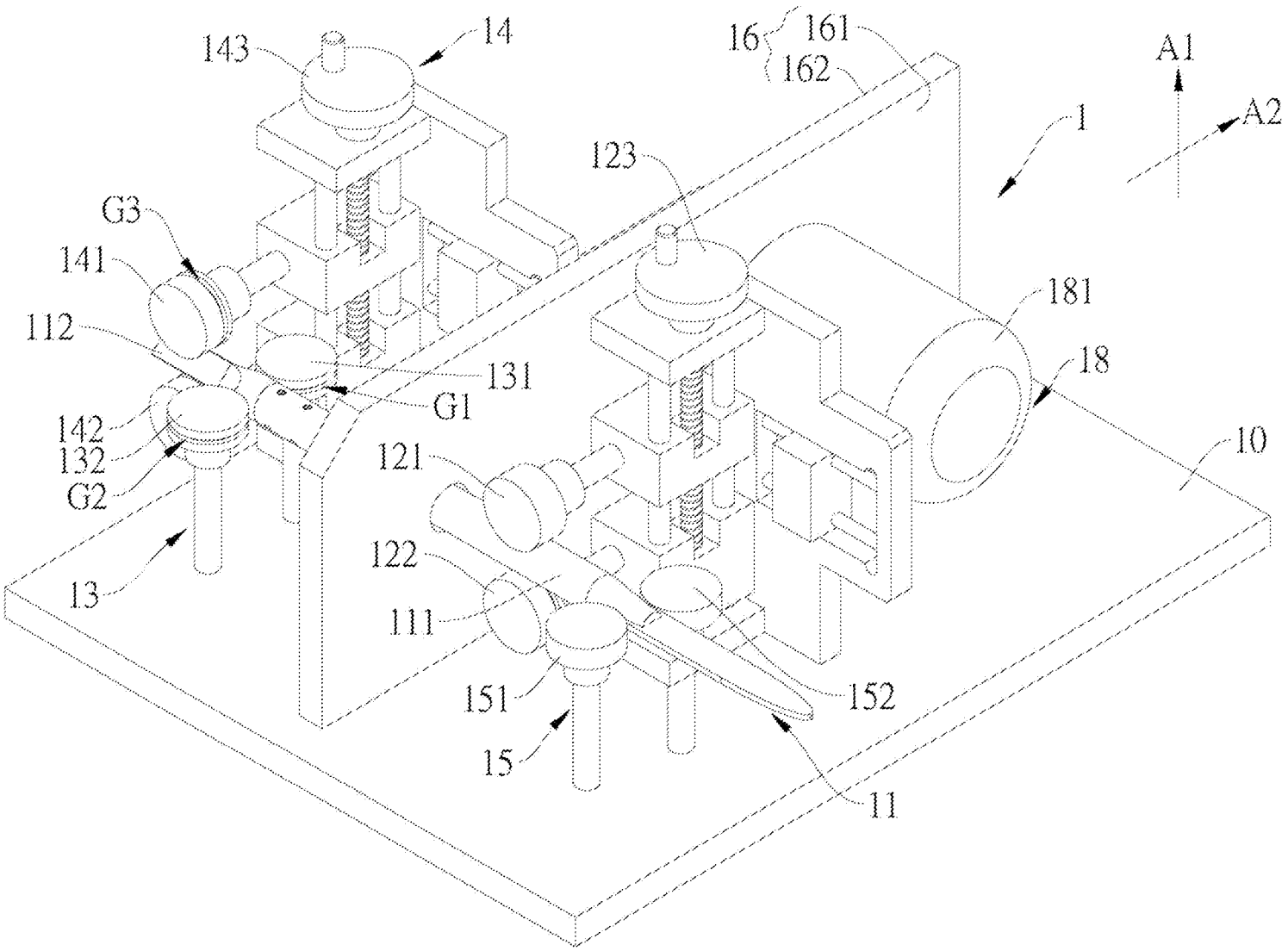
FIG. 5 is a three dimensional structure diagram showing a sleeve labeling device of a sleeve labeling machine view at another angle in the present disclosure.
Figure 6:
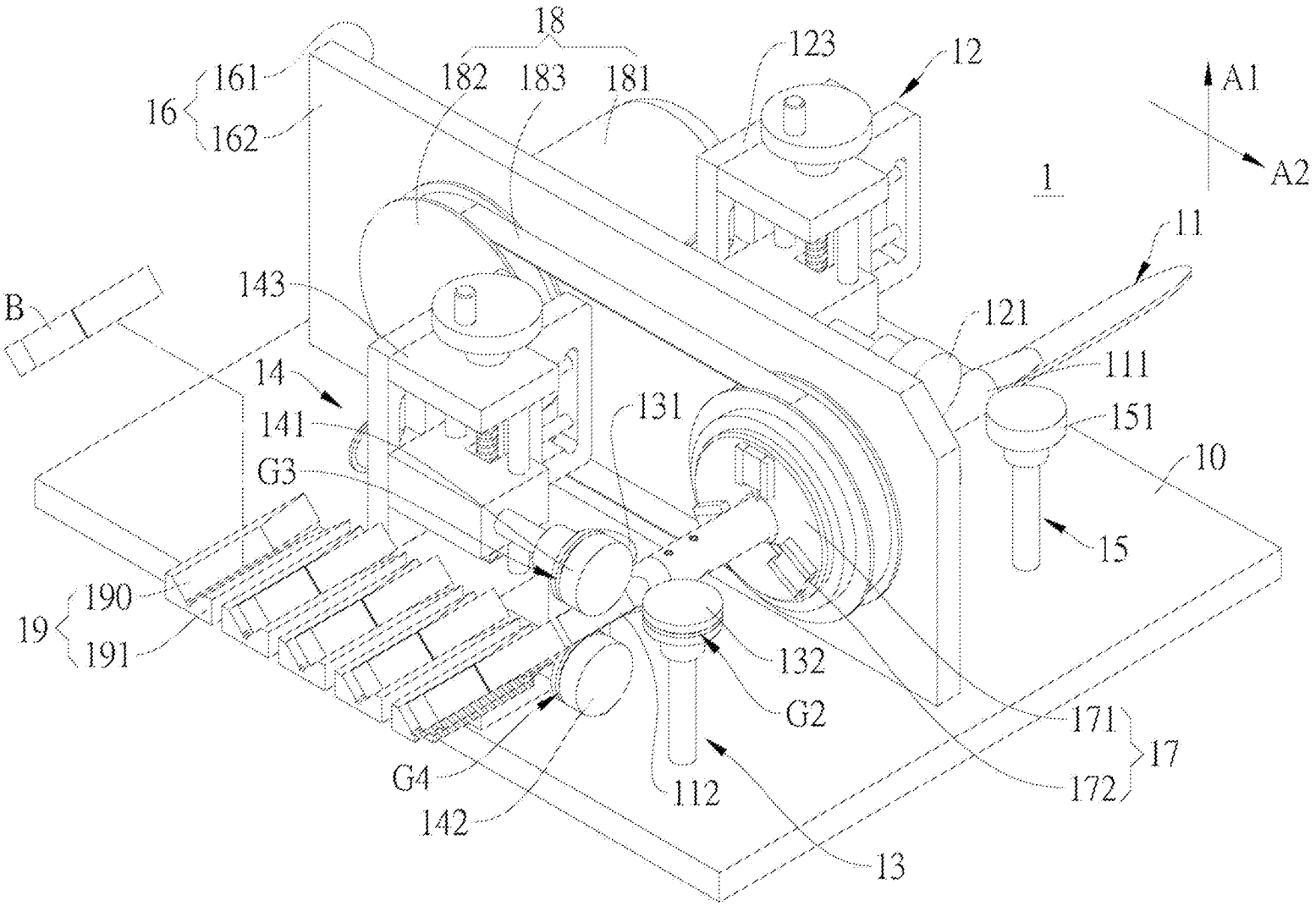
FIG. 6 is a three dimensional structure diagram showing a sleeve labeling device of a sleeve labeling machine view at another angle in the present disclosure.
Figure 7:
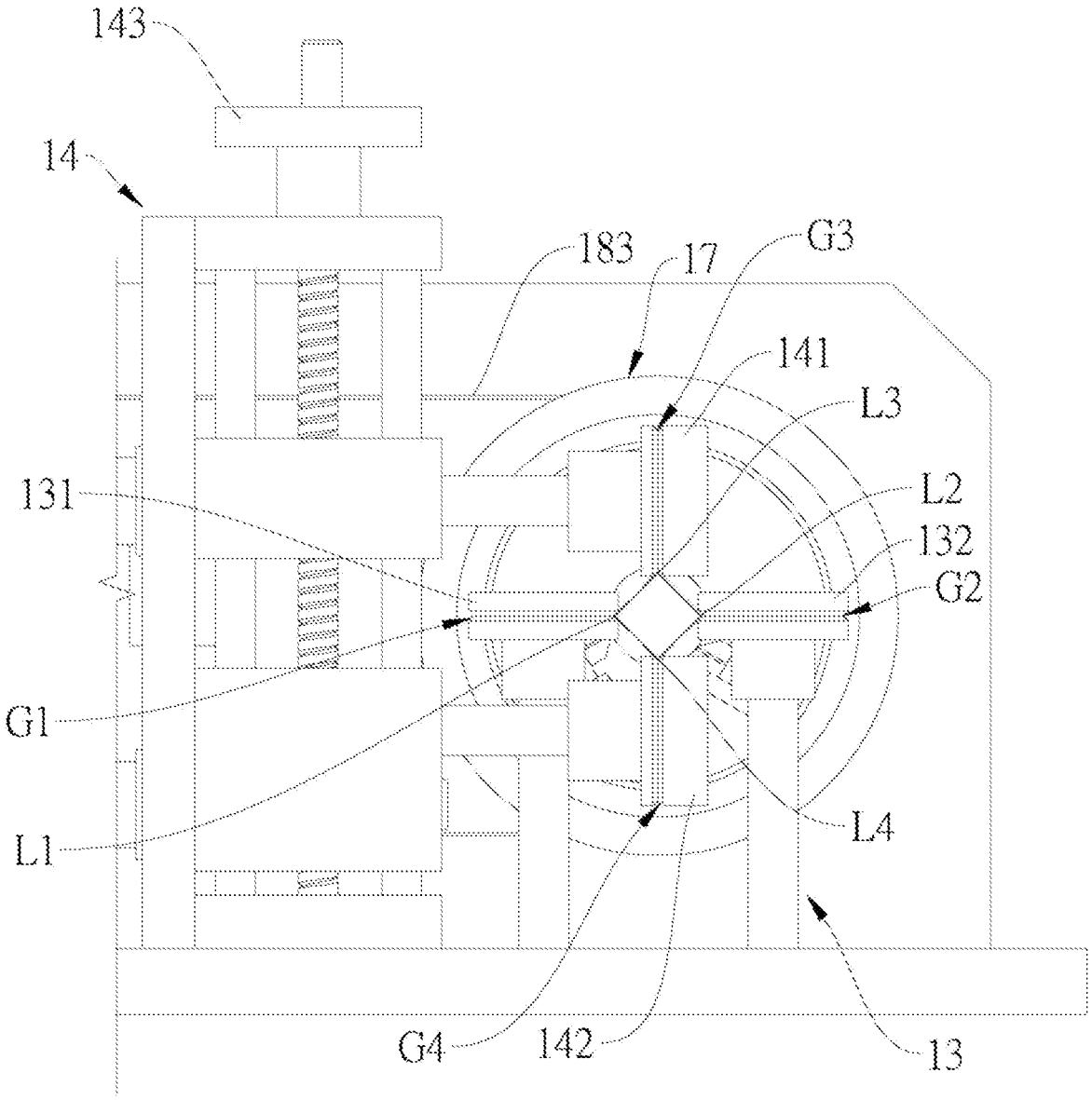
FIG. 7 is a structure diagram showing a sleeve labeling device view at another angle in the present disclosure.
Figure 8:
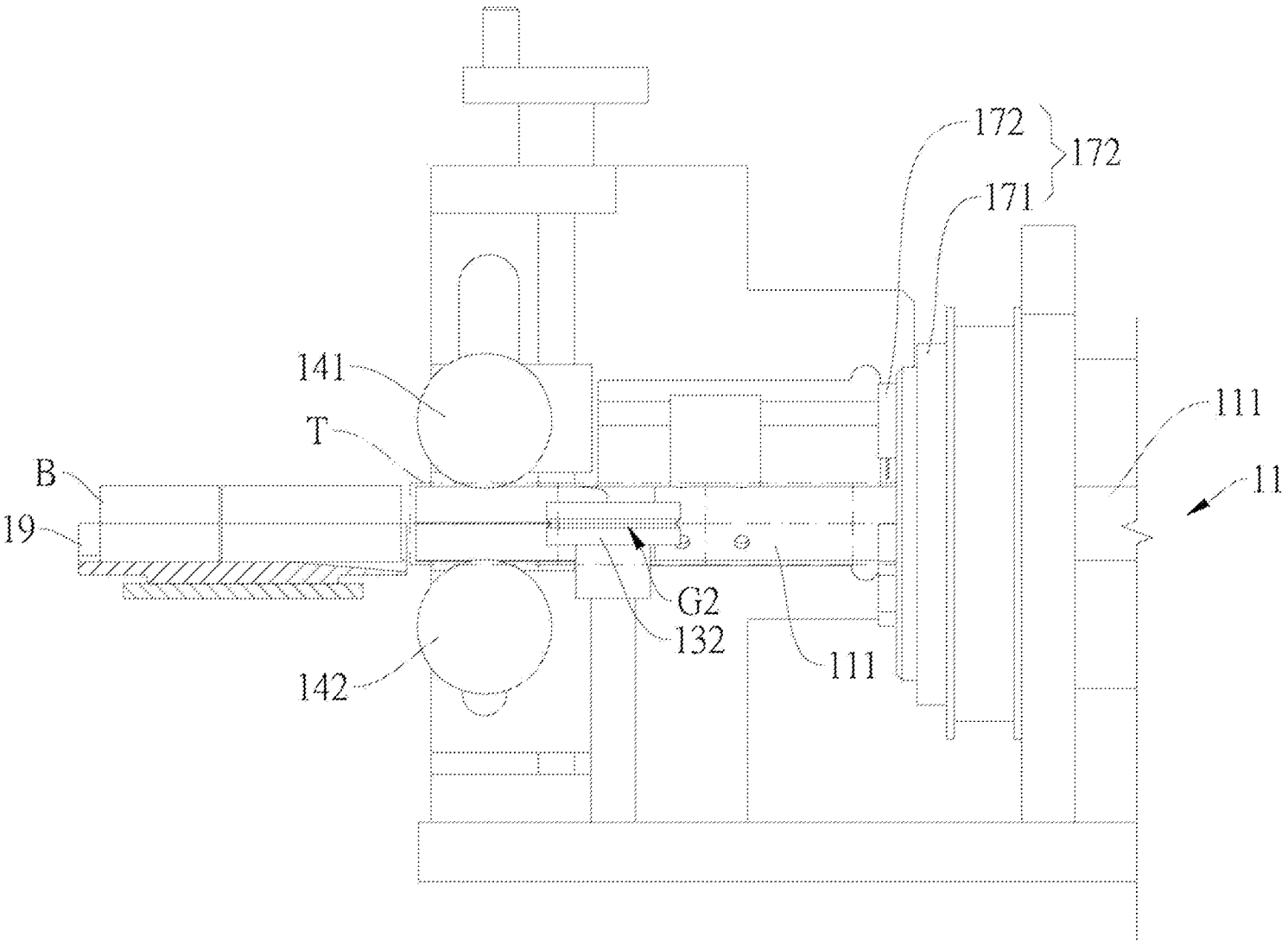
FIG. 8 is a sleeve labeling part structure diagram of a sleeve labeling device of a sleeve labeling machine in the present disclosure.
Figure 9:
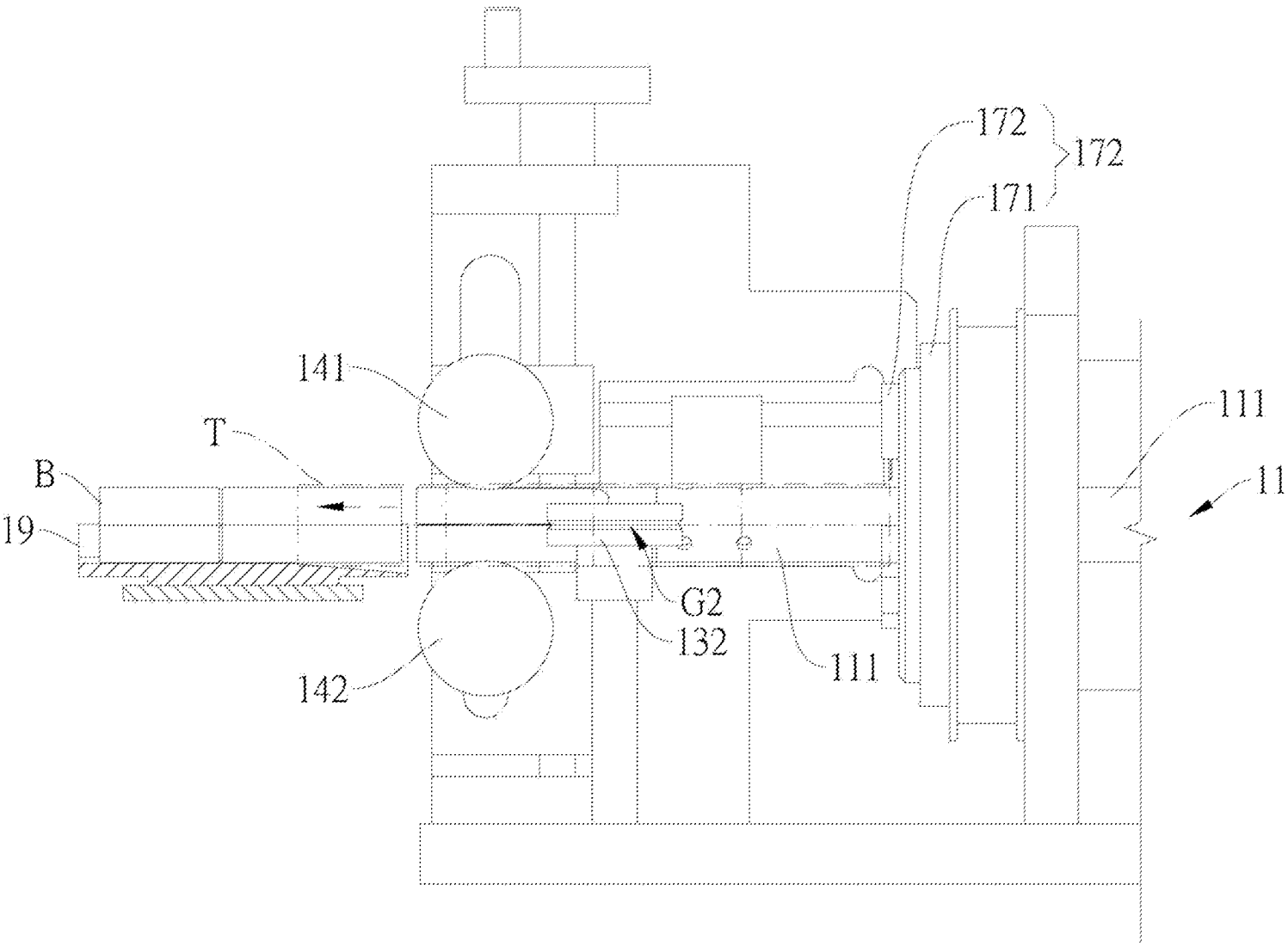
FIG. 9 is an operation diagram showing a sleeve labeling part structure of a sleeve labeling device of a sleeve labeling machine in the present disclosure.

Referring to FIG. 1 through FIG. 6, FIG. 1 shows the structure of the sleeve labeling machine in the present disclosure, FIG. 2 is an explosive diagram showing a mold in the sleeve labeling device of the sleeve labeling machine in the present disclosure, FIG. 3 is a three dimensional structure diagram showing a sleeve labeling device of a sleeve labeling machine in the present disclosure, FIG. 4 is an explosive diagram showing another mold of a sleeve labeling device in the present disclosure, FIG. 5 is a three dimensional structure diagram showing a sleeve labeling device of a sleeve labeling machine view at another angle in the present disclosure, and FIG. 6 is a three dimensional structure diagram showing a sleeve labeling device of a sleeve labeling machine view at another angle in the present disclosure.

As shown in FIG. 1 through FIG. 6, the sleeve labeling machine 2 in the embodiment of the present disclosure comprises a work platform 20, a feeding unit 21, a conveying unit 22, a sleeve labeling device 1, a hot drying device 23 and a pre-shrinking device 24. The feeding unit 21 is allocate on the work platform 20 and carries objects B to be sleeved with labels T. In the embodiment, the objects B to be sleeved with the labels can be bottles or cans, for example, and the present disclosure is not limited thereto. The conveying unit 22 is allocated on the work platform 20 and one side of the feeding unit 21, and configured to convey the objects B provided by the feeding unit 21. The sleeve labeling device 1 is allocated on the work platform 20, and the sleeve labeling device 1 is configured to guide the label T and sleeve the label T to the object B. The label guiding manner of the sleeve labeling device 1 is illustrated in the following paragraphs. The hot drying device 23 is allocated on the work platform 20 and performs a hot drying shrinkage operation on the objects B with the sleeved labels T. The pre-shrinking device 24 is allocated on the work platform 20 and between the sleeve labeling device 1 and the hot drying device 23, and the pre-shrinking device 24 performs a pre-shrinkage operation on the objects B with the sleeved labels T before the hot drying shrinkage operation is performed on the objects B with the sleeved labels T.

The following descriptions illustrate the details of the sleeve labeling device 1 in the embodiment of the present disclosure.

As shown in FIG. 2 through FIG. 6, the sleeve labeling device 1 in the embodiment comprises a base 10, a central guide column 11, a first guiding wheel assembly 12 and a second guiding wheel assembly 13. The central guide column 11 is allocated on the base 10, and the label T can be sleeved to the central guide column 11. The central guide column 11 comprises a column body 111 and a mold 112 connected to the column body 111, and the mold 112 is allocated adjacent to the conveying unit 22. In the embodiment, the column body 111 and the mold 112 are detachably connected to each other, the mold 112 can be a cylindrical mold as shown in FIG. 2, for example, and the present disclosure is not limited thereto. In another embodiment, the mold 112 can be a quadrilateral mold as shown in FIG. 4, hexagonal mold or other polygonal mold. The first guiding wheel assembly 12 is allocated on one side of the base 10, the first guiding wheel assembly 12 comprises a first guiding wheel 121 and a second guiding wheel 122, wherein the first guiding wheel 121 and the second guiding wheel 122 are allocated along a first axial direction A1, and the column body 111 of the central guide column 11 is allocated between the first guiding wheel 121 and the second guiding wheel 122. The second guiding wheel assembly 13 is allocated on another side of the base 10, and that is, second guiding wheel assembly 13 is allocated on the side being opposite to the first guiding wheel assembly 12. The second guiding wheel assembly 13 comprises a third guiding wheel 131 and a fourth guiding wheel 132, wherein the third guiding wheel 131 and the fourth guiding wheel 132 are allocated along a second axial direction A2, and the mold 12 of the central guide column 11 is allocated between the third guiding wheel 131 and the fourth guiding wheel 132. In the embodiment, the first axial direction A1 and the second axial direction A2 are vertical to each other, for example, and that is, the allocating direction of the first guiding wheel 121 and the second guiding wheel 122 in the embodiment is vertical to that of the third guiding wheel 131 and the fourth guiding wheel 132, and the present disclosure does not limit the allocating manner of the first guiding wheel assembly 12 and the second guiding wheel assembly 13.

As shown in FIG. 2 through FIG. 6, the sleeve labeling device 1 in the embodiment further comprises a third guiding wheel assembly 14. The third guiding wheel assembly 14 is allocated on the base 10, and the second guiding wheel assembly 13 is allocated between the third guiding wheel assembly 14 and the first guiding wheel assembly 12. The third guiding wheel assembly 14 comprises a fifth guiding wheel 141 and a sixth guiding wheel 142, both of which are allocated along a first axial direction A1. That is, the allocating direction of the fifth guiding wheel 141 and the sixth guiding wheel 142 is the same as that of the first guiding wheel 121 and the second guiding wheel 122, and the mold 112 of the central guide column 11 is disposed between the fifth guiding wheel 141 and the sixth guiding wheel 142.

As shown in FIG. 2 through FIG. 6, the first guiding wheel assembly 12 in the embodiment further comprises a first adjustment unit 123, and the third guiding wheel assembly 14 further comprises a second adjustment unit 143. In the embodiment, the first adjustment unit 123 can adjust the gap between the first guiding wheel 121 and the second guiding wheel 122, and the second adjustment unit 143 can adjust the gap between the fifth guiding wheel 141 and the sixth guiding wheel 142, such that the first guiding wheel 121, the second guiding wheel 122, the fifth guiding wheel 141 and the sixth guiding wheel 142 can contact the label T properly and guide the label T successfully. In addition, the second guiding wheel assembly 13 can further comprises a adjustment unit (not shown in the drawings) for adjusting the gap between the third guiding wheel 131 and the fourth guiding wheel 132.

As shown in FIG. 2 through FIG. 6, the sleeve labeling device 1 further comprises an auxiliary wheel assembly 15 allocated on the base 10, and the first guiding wheel assembly 12 is allocated between the auxiliary wheel assembly 15 and the second guiding wheel assembly 13. The auxiliary wheel assembly 15 comprises a first auxiliary wheel 151 and a second auxiliary wheel 152, both of which are allocated along the second axial direction A2. The column body 111 of the central guide column 11 is allocated between the first auxiliary wheel 151 and the second auxiliary wheel 152. The auxiliary wheel assembly 15 is used to provide a stable supporting ability for the central guide column 11, such that the central guide column 11 will not shake or skew when sleeving the label T to the object B. It is noted that the auxiliary wheel assembly 15 may be removed or allocated depending on the actual requirements.

As shown in FIG. 2 through FIG. 6, the sleeve labeling device 1 further comprises a plate body 16. The plate body 16 is allocated on the base 10 and extends along first axial direction A1 and away from the base 10. The plate body 16 comprises a first surface 161 and a second surface 162 being opposite to the first surface 161, the first surface 161 faces to the first guiding wheel assembly 12, the second surface 162 faces to the second guiding wheel assembly 13 and the third guiding wheel assembly 14, the central guide column 11 penetrates from the first surface 161 to the second surface 162 and is disposed through the plate body 16.

As shown in FIG. 2 through FIG. 6, the sleeve labeling device 1 further comprises a rotary cutter assembly 17 allocated on the plate body 16, and in the embodiment, the rotary cutter assembly 17 is for example allocated on the second surface 162 of the plate body 16, and the present disclosure does not limit the allocating position of the rotary cutter assembly 17. The rotary cutter assembly 17 comprises a rotating wheel 171 and cutters 172 allocated on the rotating wheel 171, and the cutters 172 surround the central guide column 11. When the first guiding wheel assembly 12, the second guiding wheel assembly 13 and the third guiding wheel assembly 14 guides the label T to a predetermined position P, the cutters 172 cuts the label T at the predetermined position P. It is noted that, the predetermined position P varies in response to the distance that the label T move to the object B, and that is, the rotary cutter assembly 17 determines the length of the label T according to the predetermined position P which the cutters 172 cut the label T.

As shown in FIG. 2 through FIG. 6, the sleeve labeling device 1 further comprises a driving assembly 18. The driving assembly 18 is allocated on the plate body 16, and the driving assembly 18 comprises a motor 181, a drive wheel 182 and a drive belt 183. In the embodiment, the motor 181 is allocated on the first surface 161 of the plate body 16, drive wheel 182 is allocated on the second surface 162 of the plate body 16, the drive belt 183 is sleeve to the drive wheel 182 and the rotating wheel 171 of the rotary cutter assembly 17, and the present disclosure does not limit the allocations of the above components. As shown in FIG. 6, the motor 181 drives the drive wheel 182 to rotate and drive the drive belt 183, so that the drive belt 183 drives the rotating wheel 171 to rotate, and the cutters 172 of the rotary cutter assembly 17 rotates in respect to the central guide column 11.

As mentioned above, as shown in FIG. 4 through FIG. 9 and FIG. 11, in one embodiment, the mold 112 can be that quadrilateral mold, the sleeve labeling device 1 provides the label T, and the label T is sleeved to the central guide column 11. When the first guiding wheel 121 and the second guiding wheel 122 are disposed on two sides of one terminal of the central guide column 11, both of them rotate with a reversed direction to contact and transmit the label T; and when the third guiding wheel 131 and the fourth guiding wheel 132 are disposed on two sides of another terminal of the central guide column 11, both of them rotate with a reversed direction to contact the label T to transmit the label T more smoothly. When the label T is guided to the predetermined position P, the rotating wheel 171 is activated to drive the cutters 172 to rotate, such that the label T at the predetermined position P is cut and separated by the rotating cutters 172. Further, by discontinuous rotation of the third guiding wheel 131 and the fourth guiding wheel 132, it causes a drawing force for the label T, and therefore, not only the transmitting force of the label T is compensated, but also provides an auxiliary drawing force for separating the cut label T.

Further, the feeding unit 21 provides the objects B to be sleeved with the labels to the conveying unit 22, and the objects B are arranged adjacent to each other and conveyed. The conveying unit 22 is set to transmit each of the objects B to the mold 112 with fixed transmitting seconds, wherein the transmitting of the objects B to the mold 112 means the object B is transmitted to make the central axis of the object B correspond to the central axis of the mold 112. The third guiding wheel 131 and the fourth guiding wheel 132 rotate discontinuously with the fixed transmitting seconds, such that the object B can be precisely aligned to the center of the cut label T, and by using the fifth guiding wheel 141 and the sixth guiding wheel 142, the cut label T is precisely pushed and sleeved into the object B.

Further, in the embodiment, the third guiding wheel 131 of the second guiding wheel assembly 13 has a first groove G1 which has an opening facing to the mold 112, and the fourth guiding wheel 132 of the second guiding wheel assembly 13 has a second groove G2 which has an opening facing to the mold 112. Specifically, the first groove G1 of the third guiding wheel 131 and the second groove G2 of the fourth guiding wheel 132 are respectively disposed on the two sides of the mold 112 of the central guide column 11. When the first guiding wheel assembly 12 and the second guiding wheel assembly 13 guide the label T from the column body 111 to the mold 112, the first groove G1 and the second groove G2 respectively form a first fold line L1 and a second fold line L2 on the label T. Specifically, the first groove G1 and the second groove G2 are respectively coupled to two opposite corners of the mold 112. When the third guiding wheel 131 and the fourth guiding wheel 132 guides the label T to pass the mold 112, the label T is pressed to form the first fold line L1 and the second fold line L2 in advance.

Next, the fifth guiding wheel 141 of the he third guiding wheel assembly 14 has a third groove G3 which has an opening facing to the mold 112, and the sixth guiding wheel 142 of the third guiding wheel assembly 14 has a fourth groove G4 which has an opening facing to the mold 112. Specifically, the third groove G3 of the fifth guiding wheel 141 and the fourth groove G4 of the sixth guiding wheel 142 are respectively disposed on the two sides of the mold 112 of the central guide column 11. When the first guiding wheel assembly 12, the second guiding wheel assembly 13 and the third guiding wheel assembly 14 guide the label T from the column body 111 to the mold 112, the third groove G3 of the fifth guiding wheel 141 and the fourth groove G4 of the sixth guiding wheel 142 respectively form a third fold line L3 and a fourth fold line L4 on the label T. Specifically, the third groove G3 and the fourth groove G4 are respectively coupled to two opposite corners of the mold 112, and when the fifth guiding wheel 141 and the sixth guiding wheel 142 guide the label T to pass the mold 112, the label T is pressed to form the third fold line L3 and the fourth fold line L4 in advance. The label is pressed to form a quadrilateral shape defined by the first fold line L1, the second fold line L2, the third fold line L3 and the fourth fold line L4, and the quadrilateral shape formed by the label T corresponds to the quadrilateral shape of the object B, so that the label T can be pushed and sleeved to the object B more precisely and smoothly.

Figure 10:
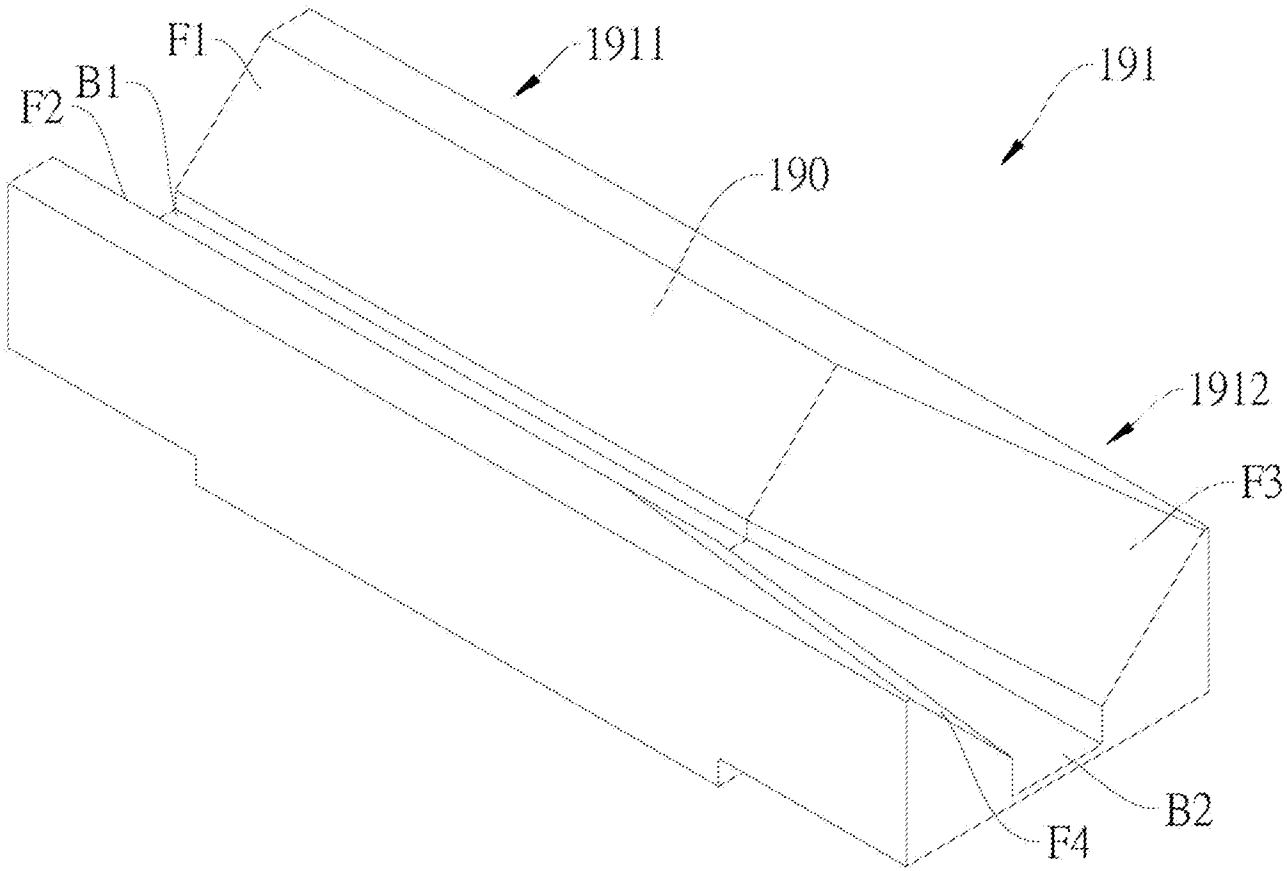
FIG. 10 is a three dimensional structure diagram showing a carrier a sleeve labeling device associated with a sleeve labeling machine in the present disclosure.

As shown in FIG. 4 through FIG. 10, the sleeve labeling device 1 further comprises a carrier platform 19. The carrier platform 19 is movably disposed on the base 10 and near the mold 112 of the central guide column 11, and the carrier platform 19 comprises carriers 191. Each of the carriers 191 has housing space 190 for accommodating the object B to be sleeved with the label T. Specifically, as shown in FIG. 10, each of the carriers 191 comprises a first carrying part 1911 and a second carrying part 1912. The first carrying part 1911 has a first bevel surface F1, a second bevel surface F2 and a first bottom concave surface B1 being adjacent to and between the first bevel surface F1 and the second bevel surface F2, wherein the first bevel surface F1 and the second bevel surface F2 tilt away from each other. The second carrying part 1912 has a third bevel surface F3, a fourth bevel surface F4 and a second bottom concave surface B2 being adjacent to and between the third bevel surface F3 and the fourth bevel surface F4, wherein the third bevel surface F3 and the fourth bevel surface F4 tilt away from each other. The third bevel surface F3 and the fourth bevel surface F4 expand outward from the first bevel surface F1 and the second bevel surface F2 to the central guide column 11. The second bottom concave surface B2 expands outward from the first bottom concave surface B1 to the central guide column 11. The first bevel surface F1, the second bevel surface F2, the first bottom concave surface B1, the third bevel surface F3, the fourth bevel surface F4 and the second bottom concave surface B2 define the housing space 190. Since the third bevel surface F3, the fourth bevel surface F4 and the second bottom concave surface B2 expand outward, the object B is disposed on the carrier platform 19 contacts the first bevel surface F1 and the second bevel surface F2, the central axis of the object B is aligned to the central axis of the mold 112, and the housing space 190 makes the object B to have gaps to the third bevel surface F3, the fourth bevel surface F4 and the second bottom concave surface B2, the label T on the central guide column 11 can be pushed and sleeved to the object B more smoothly.

Figure 11:
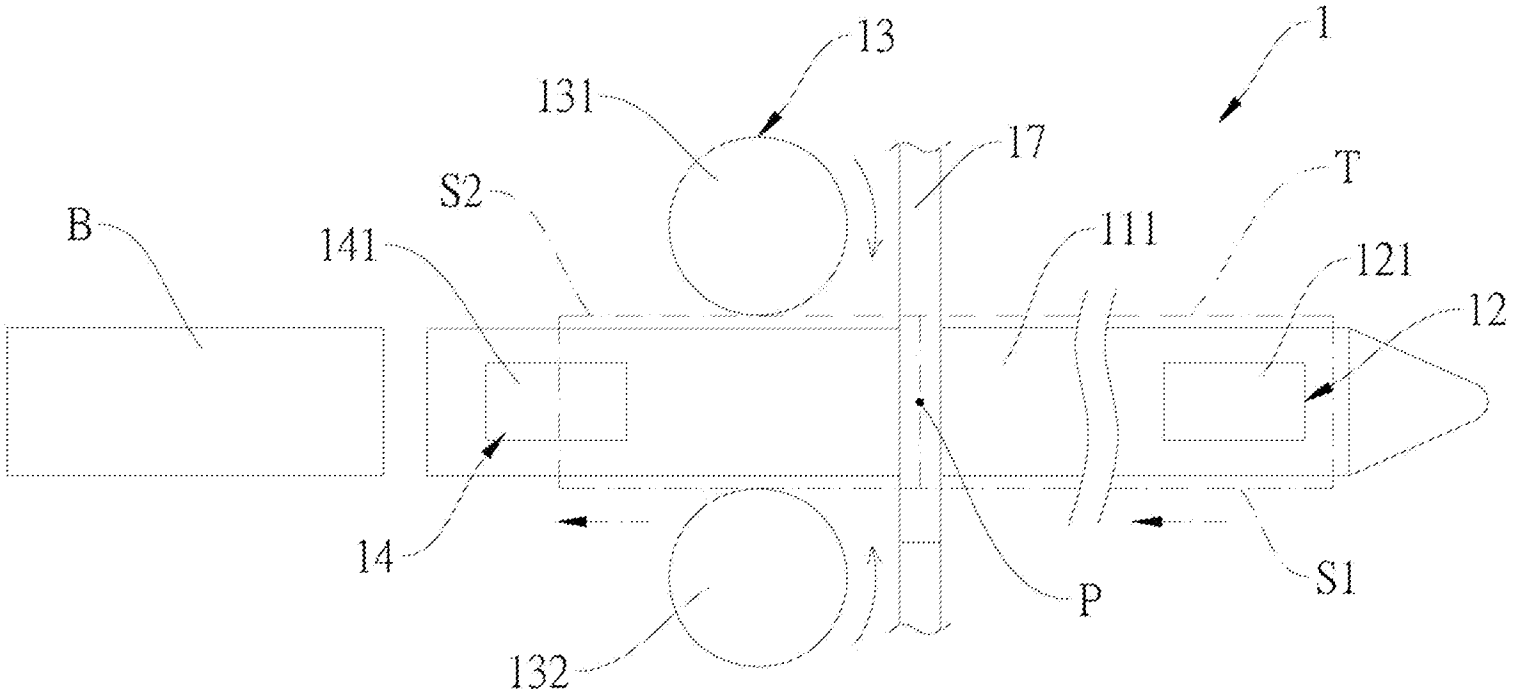
FIG. 11 is a first procedure diagram showing a label guiding manner of a sleeve labeling machine in the present disclosure.
Figure 12:
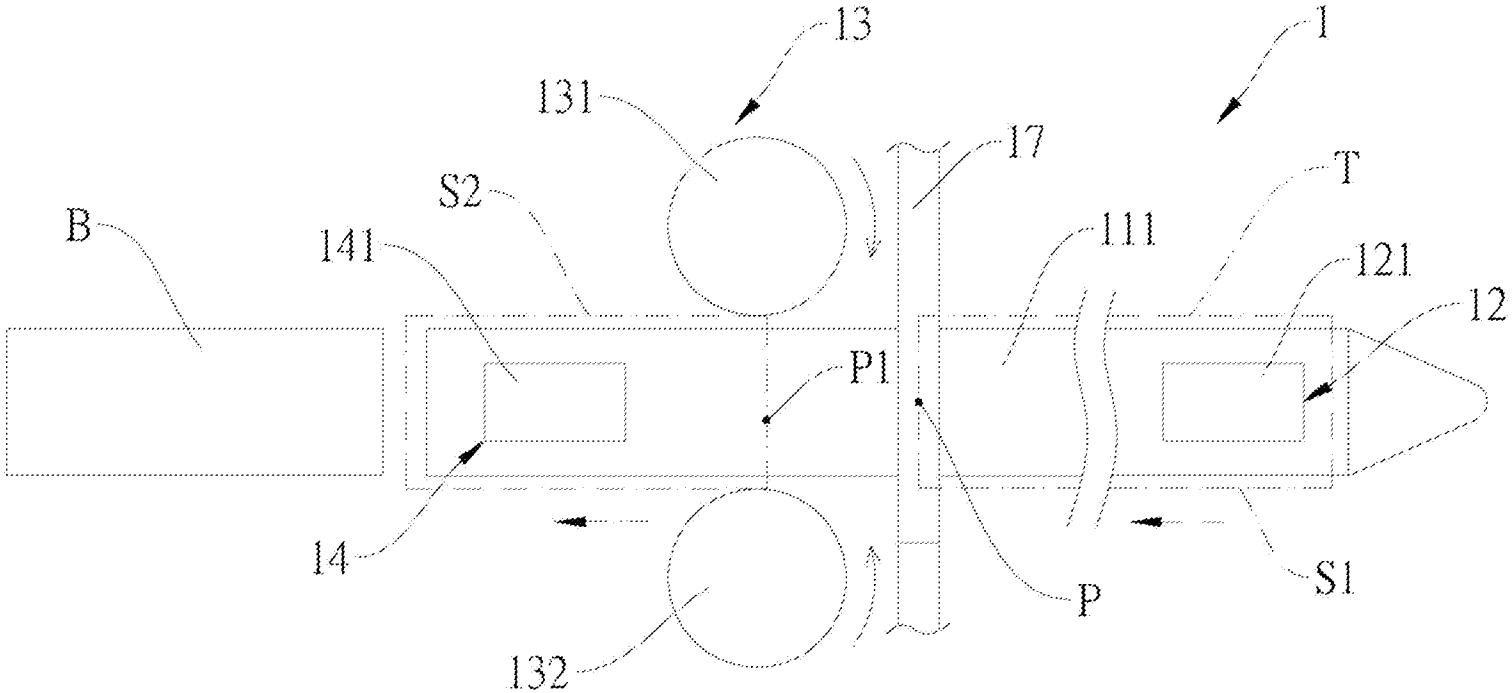
FIG. 12 is a second procedure diagram showing a label guiding manner of a sleeve labeling machine in the present disclosure.
Figure 13:
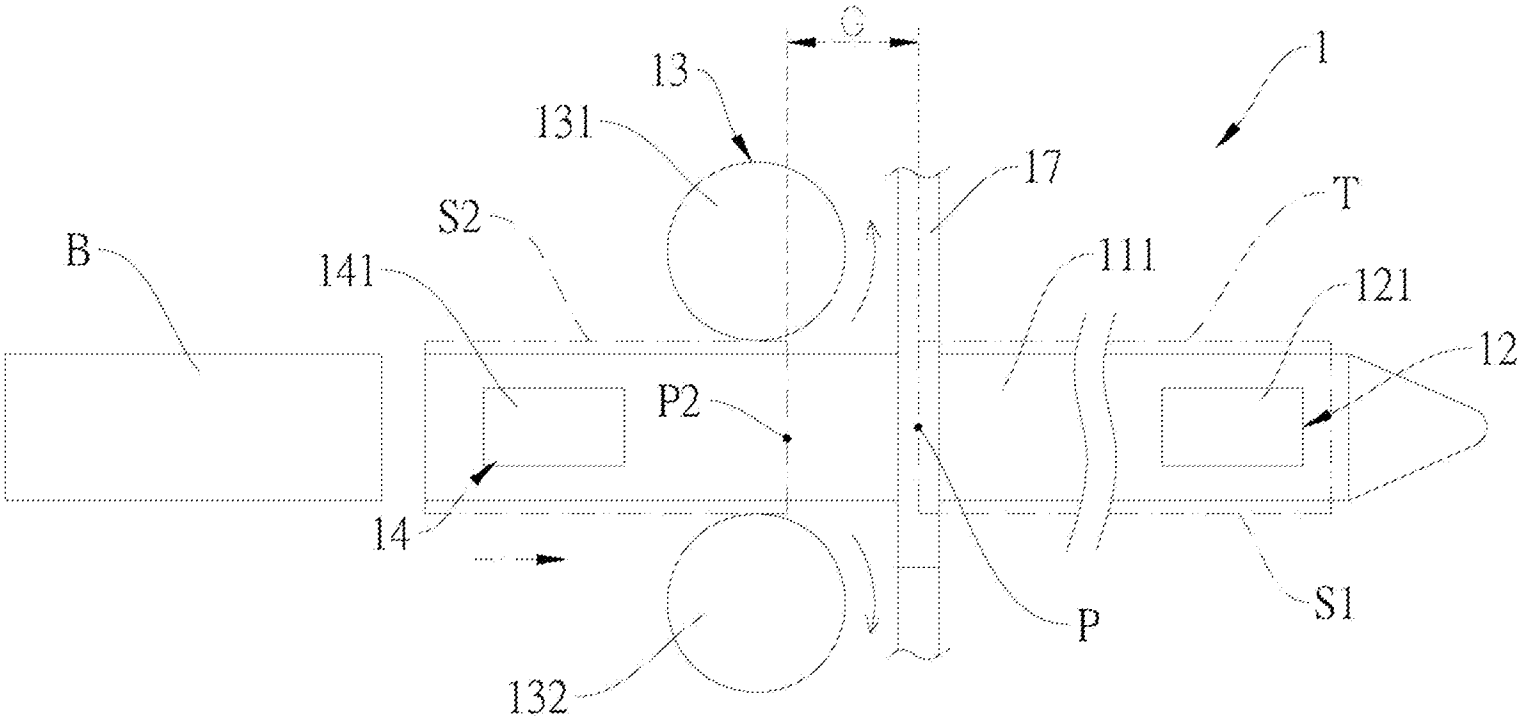
FIG. 13 is a third procedure diagram showing a label guiding manner of a sleeve labeling machine in the present disclosure.

Referring to FIG. 11 through FIG. 13, FIG. 11 through FIG. 13 shows the procedure diagram of the label guiding method in the embodiment of the present disclosure. Firstly, as shown in FIG. 11, the first guiding wheel assembly 12, the second guiding wheel assembly 13 and the third guiding wheel assembly 14 of the sleeve labeling device 1 guide the label T to the predetermined position P, the second guiding wheel assembly 13 rotates discontinuously, and at the same time, the rotary cutter assembly 17 cuts the label T at the predetermined position P to form the first segment label S1 and the second segment label S2. Next, as shown in FIG. 12, the second guiding wheel assembly 13 and the third guiding wheel assembly 14 guides the second segment label S2 to move to the first position P1 near the object B. Next, as shown in FIG. 13, the second guiding wheel assembly 13 and the third guiding wheel assembly 14 guides the second segment label S2 to move to the second position P2 away from the object B, so that second segment label S2 and the first segment label S1 have a segment gap G therebetween. By the guiding manner, it make sure that the second segment label S2 can be separated from the first segment label S1 completely, and it can avoid the case the label T is cut incompletely. Therefore, the second segment label S2 can be precisely and quickly sleeved to the object B. It is noted that, the first guiding wheel assembly 12, the second guiding wheel assembly 13 and the third guiding wheel assembly 14 are used to guide the label T in one embodiment, but in another embodiment, the third guiding wheel assembly 14 can be removed, and merely the first guiding wheel assembly 12 and the second guiding wheel assembly 13 are used to guide the label T.

According to the above descriptions, the sleeve labeling machine of the embodiment of the present disclosure utilizes its first guiding wheel assembly and second guiding wheel assembly to guide the label to a predetermined position, then utilizes its rotary cutter assembly to cut the label at the predetermined position into the first and second segment labels, and before the second segment label is sleeved to the object, the second guiding wheel assembly guides the second segment label to move, so that the first and second segment labels have the segment gap therebetween. When the label is not cut completely, by such guiding manner, it can make sure that the cut label can depart completely, such that the label can be precisely and quickly sleeved to the object, and the yielding rate of sleeving the labels is increased efficiently. Further, the sleeve labeling machine of the embodiment of the present disclosure has a simple structure design, and the label is merely guided by the first guiding wheel assembly and the second guiding wheel assembly to be successfully sleeved to the object without allocating an additional label distribution tray or other device. Therefore, under such structure design, the manufacturing cost can be dramatically reduced, and the yielding rate of sleeving the labels is greatly increased.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A sleeve labeling device, comprising:

a base;

a central guide column, allocated on the base, the central guide column comprises a column body and a mold connected to the column body;

a first guiding wheel assembly, allocated on one side of the base, the first guiding wheel assembly comprises a first guiding wheel and a second guiding wheel, both of which are allocated along a first axial direction, and the column body is allocated between the first guiding wheel and the second guiding wheel;

a second guiding wheel assembly, allocated on another side of the base, the second guiding wheel assembly comprises a third guiding wheel and a fourth guiding wheel, both of which are allocated along a second axial direction, and the first axial direction is not parallel to the second axial direction;

a third guiding wheel assembly allocated on the base, the second guiding wheel assembly is disposed between the third guiding wheel assembly and the first guiding wheel assembly, the first guiding wheel assembly, the second guiding wheel assembly and the third guiding wheel assembly guide a label to a predetermined position, the third guiding wheel assembly comprises a fifth guiding wheel and a sixth guiding wheel, both of which are allocated along the first axial direction, and the mold is disposed between the third guiding wheel, the fourth guiding wheel, the fifth guiding wheel and the sixth guiding wheel; and an auxiliary wheel assembly allocated on the base, the first guiding wheel assembly is disposed between the auxiliary wheel assembly and the second guiding wheel assembly, the auxiliary wheel assembly comprises a first auxiliary wheel and a second auxiliary wheel, both of which are allocated along the second axial direction, and the column body is disposed between the first auxiliary wheel and the second auxiliary wheel.

2. The sleeve labeling device according to claim 1, wherein the third guiding wheel has a first groove which has an opening facing to the mold, the fourth guiding wheel has second groove which has an opening facing to the mold, when the first guiding wheel assembly and the second guiding wheel assembly guide the label from the column body to the mold, the first groove and the second groove respectively form a first fold line and a second fold line on the label.

3. The sleeve labeling device according to claim 2, wherein the fifth guiding wheel has a third groove which has an opening facing to the mold, the sixth guiding wheel has a fourth groove which has an opening facing to the mold, when the first guiding wheel assembly, the second guiding wheel assembly and the third guiding wheel assembly guide the label from the column body to the mold, the third groove and the fourth groove respectively form a third fold line and a fourth fold line on the label, and the first fold line, the second fold line, the third fold line and the fourth fold line are not overlapped.

4. The sleeve labeling device according to claim 3, wherein the first guiding wheel assembly comprises a first adjustment unit, the third guiding wheel assembly comprises a second adjustment unit, the first adjustment unit adjusts a gap between the first guiding wheel and the second guiding wheel, and the second adjustment unit adjusts a gap between the fifth guiding wheel and the sixth guiding wheel.

5. A sleeve labeling device, comprising:

a base;

a central guide column, allocated on the base, the central guide column comprises a column body and a mold connected to the column body;

a first guiding wheel assembly, allocated on one side of the base, the first guiding wheel assembly comprises a first guiding wheel and a second guiding wheel, both of which are allocated along a first axial direction, and the column body is allocated between the first guiding wheel and the second guiding wheel;

a second guiding wheel assembly, allocated on another side of the base, the second guiding wheel assembly comprises a third guiding wheel and a fourth guiding wheel, both of which are allocated along a second axial direction, the first axial direction is not parallel to the second axial direction, and the mold is allocated between the third guiding wheel and the fourth guiding wheel;

a plate body allocated on the base, the plate body extends along first axial direction and away from the base, the plate body comprises a first surface and a second surface being opposite to the first surface, the first surface faces to the first guiding wheel assembly, the second surface faces to the second guiding wheel assembly, the central guide column penetrates from the first surface to the second surface and is disposed through the plate body, a rotary cutter assembly allocated on the plate body, the rotary cutter assembly comprises a rotating wheel and cutters allocated on the rotating wheel, the cutters surround the central guide column, when the first guiding wheel assembly and the second guiding wheel assembly guide the label to a predetermined position, the cutters cuts the label at the predetermined position; and a driving assembly allocated on the plate body, the driving assembly comprises a motor, a drive wheel and a drive belt, wherein the drive belt is sleeved to the drive wheel and the rotating wheel of the rotary cutter assembly, the motor drives the drive wheel to rotate and drive the drive belt, so that the drive belt drives the rotating wheel to rotate, and the cutters of the rotary cutter assembly rotates in respect to the central guide column.

6. A sleeve labeling device, comprising:

a base;

a central guide column, allocated on the base, the central guide column comprises a column body and a mold connected to the column body;

a first guiding wheel assembly, allocated on one side of the base, the first guiding wheel assembly comprises a first guiding wheel and a second guiding wheel, both of which are allocated along a first axial direction, and the column body is allocated between the first guiding wheel and the second guiding wheel;

a second guiding wheel assembly, allocated on another side of the base, the second guiding wheel assembly comprises a third guiding wheel and a fourth guiding wheel, both of which are allocated along a second axial direction, the first axial direction is not parallel to the second axial direction, and the mold is allocated between the third guiding wheel and the fourth guiding wheel; and a carrier platform movably disposed on the base and near the mold of the central guide column, the carrier platform comprises carriers, and each of the carriers has housing space for accommodating an object to be sleeved with the label.

7. The sleeve labeling device according to claim 6, wherein each of the carriers comprises a first carrying part and a second carrying part, the first carrying part has a first bevel surface, a second bevel surface and a first bottom concave surface being adjacent to and between the first bevel surface and the second bevel surface, the first bevel surface and the second bevel surface tilt away from each other, the second carrying part has a third bevel surface, a fourth bevel surface and a second bottom concave surface being adjacent to and between the third bevel surface and the fourth bevel surface, the third bevel surface and the fourth bevel surface tilt away from each other, and the third bevel surface and the fourth bevel surface expand outward from the first bevel surface and the second bevel surface to the central guide column, the second bottom concave surface expands outward from the first bottom concave surface to the central guide column, and the first bevel surface, the second bevel surface, the first bottom concave surface, the third bevel surface, the fourth bevel surface and the second bottom concave surface define the housing space.

8. A sleeve labeling machine, comprising:

the sleeve labeling device according to claim 1;

a work platform;

a feeding unit, allocated on the work platform, configured to carry objects to be sleeved with labels;

a conveying unit, allocated on the work platform and one side of the feeding unit, and the mold is disposed adjacent to the conveying unit; and a hot drying device, allocated on the work platform and on one side of the conveying unit.

9. The sleeve labeling machine according to claim 8, wherein the sleeve labeling machine comprises a pre-shrinking device allocated on the work platform and between the sleeve labeling device and the hot drying device.

10. The sleeve labeling device according to claim 1, wherein the sleeve labeling machine comprises a rotary cutter assembly, the rotary cutter assembly cuts the label at the predetermined position.

* * * * *